US005417284A

United States Patent [19]

Jones

[11] Patent Number: 5,417,284

[45] Date of Patent: May 23, 1995

[54] METHOD FOR FRACTURING AND PROPPING A FORMATION

[75] Inventor: Lloyd G. Jones, Dallas, Tex.

[73] Assignee: Mobil Oil Corporation, Fairfax, Va.

[21] Appl. No.: 254,623

[22] Filed: Jun. 6, 1994

[51] Int. Cl.[6] ..... E21B 43/267

[52] U.S. Cl. ..... 166/280; 166/308

[58] Field of Search ..... 166/280, 308, 278, 51

[56] References Cited

U.S. PATENT DOCUMENTS

| | | | |
|---|---|---|---|
| 3,151,678 | 10/1964 | Hanson et al. | 166/42 |
| 3,868,998 | 3/1975 | Lyburger et al. | 166/278 |
| 4,685,519 | 8/1987 | Stowe et al. | 166/278 |
| 4,945,991 | 8/1990 | Jones | 166/278 |
| 5,005,649 | 4/1991 | Smith et al. | 166/317 X |
| 5,027,899 | 7/1991 | Grubert | 166/280 X |
| 5,036,920 | 8/1991 | Cornette et al. | 166/278 |
| 5,082,052 | 1/1991 | Jones et al. | 166/51 |
| 5,113,935 | 5/1992 | Jones et al. | 166/51 |
| 5,161,613 | 11/1992 | Jones | 166/242 |
| 5,161,618 | 11/1992 | Jones et al. | 166/308 |

*Primary Examiner*—William P. Neuder
*Attorney, Agent, or Firm*—Alexander J. McKillop; George W. Hager, Jr.

[57] ABSTRACT

A method for fracturing and propping a thick and/or non-homogeneous fracture interval of a subterranean formation which is traversed by a wellbore. A workstring is lowered into the wellbore and a fracturing fluid is flowed into either or both ends of the fracture interval annulus (i.e. that portion of the well annulus which lies adjacent the fracture interval) to initiate a fracture. The flow of fracturing fluid is continued into one end of the annulus while a slurry containing proppants is flowed into the other end of the fracture interval annulus. During flow of fracturing fluid and slurry into the annulus, slurry and/or fracturing fluid is also delivered through alternate flowpaths to different levels within said fracture interval. This is continued until all of the levels or zones of the fracture interval have been fractured and propped.

19 Claims, 5 Drawing Sheets

METHOD FOR FRACTURING AND PROPPING A FORMATION

DESCRIPTION

1. Technical Field

The present invention relates to a method for fracturing and propping a subterranean formation and in one of its aspects relates to a method for completing a fracture interval in a subterranean formation wherein a fracture is first initiated in the formation with a fracturing fluid and then enlarged and propped by continuing to pump the fracturing fluid into one end of the well annulus adjacent the fracture interval while simultaneously pumping a slurry containing proppants (e.g. gravel) into the other end of the well annulus and, at the same time, delivering the fracturing fluid and/or slurry to different levels within the annulus through alternate flowpaths which extend through the fracture interval.

2. Background Art

"Hydraulic fracturing" is a well known technique commonly used to increase the productivity of subterranean formations which produce hydrocarbon fluids or the like. In a typical hydraulic fracturing operation, a fracturing fluid (e.g. gel) is pumped down a wellbore and into the formation at a pressure sufficient to initiate a "fracture". The fracture(s) provides a network of permeable channels into the formation through which formation fluids can flow into the wellbore.

Unfortunately, however, such fractures have a tendency to close once the fracture pressure is relaxed. Accordingly, it is routine in the art to "prop" the fractures open by mixing proppants (e.g. sand, gravel, or other particulate material) with the fracturing fluid or by following the fracturing fluid with a slurry which contains the desired "props" or proppants. The slurry flows into the fractures where the props are deposited to thereby "prop" or hold the fractures open after the pressure is relaxed and the well is put on production.

As will be understood by those skilled in this art, problems remain in adequately fracturing and propping some formations, especially where the formation to be fractured is relatively thick (e.g. 50 feet or more) and/or is comprised of highly non-homogeneous strata. For example, in thick formations, it is difficult to initiate or extend a fracture across a second zone of the formation once a substantial fracture has been initiated in a first zone thereof (i.e. the "first" zone being the strata with lowest "break-down" pressure).

As the pressure increases in the wellbore, the fracturing fluid and/or slurry will normally take the path of least resistance and merely flow into the first zone thereby enlarging the initial fracture rather than initiating a new fracture or extending the initial fracture across a second zone of the formation.

Further, it is common to lose liquid from the slurry into the initial fracture which, in turn, causes the props, e.g. sand, to collect in the well annulus adjacent the initial fracture thereby forming a "sand bridge" in the annulus. These sand bridges block further flow of fracturing gel and/or slurry through the well annulus thereby preventing the further delivery of the necessary fluids to other levels or zones within the interval to be fractured. This is true even where some of these other zones may have previously experienced some breakdown before a sand bridge was formed.

The formation of sand bridges during the fracturing operation usually results in fractures which extend only across a portion of the desired fracture interval and/or in fractures which are inadequately propped. In either event, the full benefits of the fracturing operation are not be realized.

Due to the problems associated with the formation of sand bridges in the well annulus, currently it is common to use a series of individual, conventional fracturing operations to fracture and prop thick formations and/or non-homogeneous formations. That is, a workstring, packers, and other associated equipment are lowered into the wellbore and the wellbore is packed-off and isolated adjacent a first zone within the fracture interval. Fracturing fluid and slurry is then flowed down the wellbore to fracture and prop the isolated first zone of the fracture interval.

The packers are then released and the equipment is moved within the wellbore to a second zone of the fracture interval which is then is isolated, fractured, and propped as before. This procedure is repeated until the fractures extend across substantially the entire thickness of the fracture interval or until all of the non-homogenous zones within the fracture interval have been fractured and propped. Of course, as will be recognized by those skilled in the well completion art, this repetition of individual, conventional fracturing and propping operations in a single well is extremely expensive and time consuming and is an important consideration in the overall economics of the completion and production of the well.

To overcome the expense and time involved in having to carry out a series of individual fracturing operations to fracture and prop a thick and/or non-homogeneous interval, methods have been proposed wherein the fracturing of such an interval can be performed in a single operation; for example see U.S. Pat. No. 5,161,618 to Jones et al. The present invention provides still another method for performing such an operation.

SUMMARY OF THE INVENTION

The present invention provides a method for fracturing and propping a thick and/or non-homogeneous fracture interval of a subterranean formation which is traversed by a wellbore. Basically, the method is carried out by lowering a workstring in the wellbore wherein a well annulus is formed between the workstring and the wellbore. The workstring includes alternate flowpaths for carrying fluids to different levels within the annulus. A fracturing fluid is flowed into one end or is flowed simultaneously into both ends of that portion of the well annulus lying adjacent the fracture interval to initiate a fracture in the formation.

Once the fracture is initiated, the flow of fracturing fluid to one end of the annulus is replaced with a slurry containing proppants while flow of the fracturing fluid is continued into the other end of the annulus. During the flow of fracturing fluid and slurry into the annulus, slurry and/or fracturing fluid is also delivered through the alternate flowpaths to different levels within said fracture interval. The slurry will continue to be delivered to the respective levels or zones within the fracture interval even after the formation of a sand bridge in the annulus until all of the levels or zones have been fractured and propped. This allows thick and/or non-homogeneous fracture intervals to be fractured and propped in a single operation thus eliminating the need for the series (commonly called "stages") of individual fracturing operations.

More specifically, a fracturing workstring is positioned in wellbore substantially adjacent fracture interval. In deep wells, e.g. 1500 feet or more, the workstring will normally include a cross-over. Also, in deep wells, that portion of the well annulus lying adjacent the fracture interval is isolated by a packer carried on the workstring. The workstring has one or more shunts tubes which are radially-spaced around the workstring and which extend through the isolated fracture interval. These shunt tubes each has a plurality of outlet openings spaced along its length to provide "alternate flowpaths" for the delivery of fluids to different levels within the fracture interval. The portion of the workstring below the cross-over may also have a plurality of radial, "unloading" ports spaced along its length.

In operation, the workstring is lowered into the wellbore and forms a well annulus with the wellbore. The packer is then set to isolate that portion of the annulus (in deep wells ) which lies adjacent fracture interval. A fracturing fluid (fracturing gel) is flowed down workstring and into the annulus. The fracturing fluid can be flowed into either end of the annulus or it may be simultaneously flowed into both ends. Where fracturing fluid is flowed into both ends simultaneously, the fracturing fluid will pass through the respective passages in the cross-over and will flow into both the top and the bottom of the isolated annulus to thereby initiate a fracture in fracture interval. This fracture may be initiated at any level within the fracture interval depending as to where the level is having the lowest "break-down" pressure.

Once the fracture has been initiated, the flow of fracturing fluid into one end (preferably the bottom end) of the isolated annulus is continued while the flow of fracturing fluid into the other end (e.g. top end) is replaced with flow of a slurry which is laden with proppants (e.g. gravel and/or sand). The slurry flows into initial fracture to deposit the proppants and thereby prop the fracture while the fracturing fluid flowing through the other end of the isolated annulus continues to enlarge the initial fracture or initiate fractures in other zones of the interval.

Unfortunately, as the initial fracture is being propped, it is common for a sand bridge to form in the annulus adjacent the initial fracture which, in turn, blocks flow of slurry to other levels in the annulus thereby preventing proppants from reaching the enlarged portion of the fracture. However, with the present invention, the slurry, even if blocked by sand bridge, continues to be delivered to all levels within the fracture interval through the alternate flowpaths provided by the shunt tubes.

The simultaneous injection of fracturing fluid and slurry is continued until the fracture interval is fractured and propped across substantially its entire thickness or length or all of the zones in the interval are fractured and propped. Once the operation is complete, the workstring can be "unloaded", if desired, by changing to a reverse circulating mode and flowing a wash fluid (e.g. water) through "unloading" ports in the workstring to the sand from around the workstring.

The present invention can be used to fracture and prop intervals in vertical, inclined, or horizontal wellbores and can also be used to fracture, prop, and gravel pack a production formation within a well in a single operation. In fracturing and gravel-packing a well, a gravel pack screen is included in the workstring and is positioned adjacent the fracture interval. A plurality of shunt tubes are spaced radially around screen and provide the necessary alternate flowpaths throughout the interval to be fractured and completed. A wash pipe is connected to the cross-over and extends within the screen to near the bottom thereof.

The fracturing and propping operation using a gravel pack screen is basically the same as described above except the workstring is not unloaded and removed but, instead, the gravel pack screen is left in place and is surrounded by proppant as will be understood in the art.

BRIEF DESCRIPTION OF THE DRAWINGS

The actual construction, operation, and the apparent advantages of the present invention will be better understood by referring to the drawings in which like numerals identify like parts and in which.

BEST KNOWN MODE FOR CARRYING OUT THE INVENTION

Figure 1:
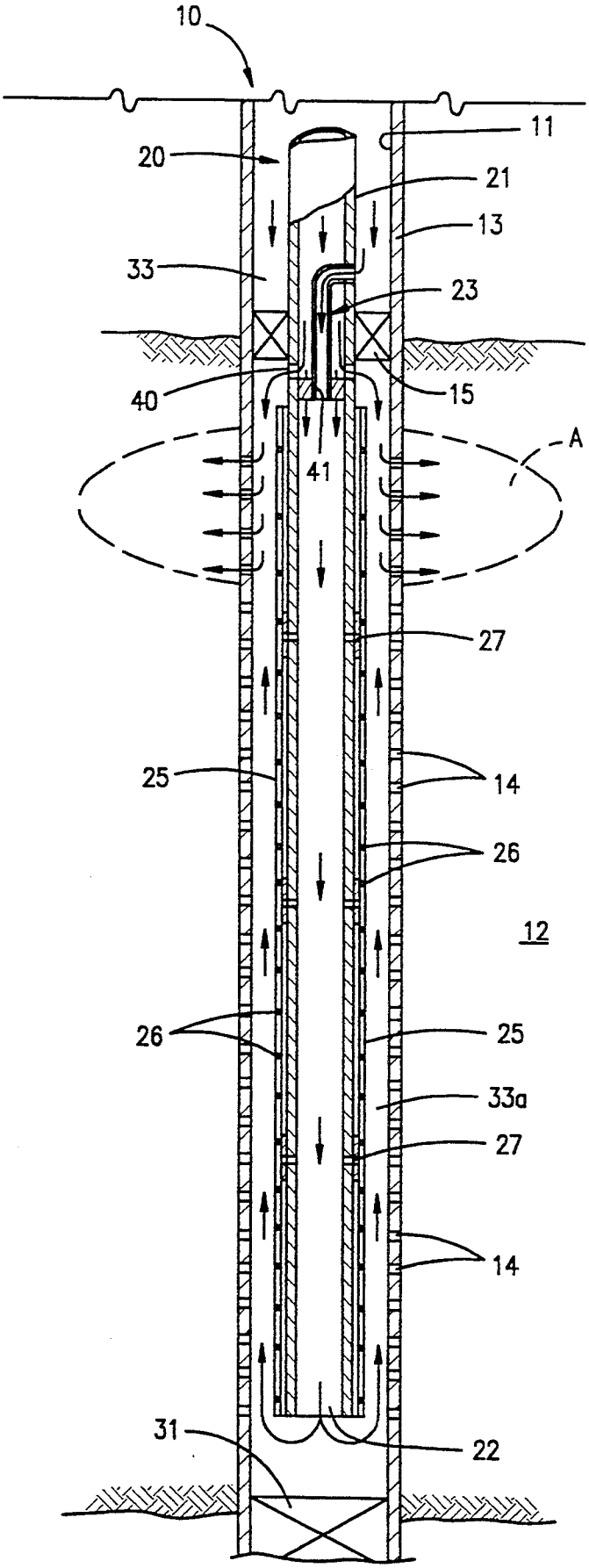
FIG. 1 is an elevational view, partly in section, of an apparatus used in carrying out the present invention as shown in an operable position within a wellbore adjacent a fracture interval wherein a fracture has been initiated in said interval.

Referring more particularly to the drawings, FIG. 1 illustrates the lower end of a producing and/or injection well 10. Well 10 has a wellbore 11 which extends from the surface (not shown) through fracture zone 12. Wellbore 11 is typically cased with a casing 13 which is cemented 13*a* (FIGS. 5 and 6) in place. While the method of the present invention is illustrated primarily as being carried out in a vertical cased wellbore, it should be recognized that the present invention can equally be used in open-hole and/or underreammed completions as well as in inclined and horizontal wellbores (FIG. 4) as the situation dictates.

As illustrated, fracture interval 12 is a thick formation having a substantial length which extends vertically along wellbore 11. Casing 13 may have perforations 14 throughout fracture interval 12 or may be perforated at selected levels within the fracture interval. Since the present invention is also applicable for use in horizontal and inclined wellbores, the terms "upper and lower", "top and bottom", as used herein are relative terms and are intended to apply to the respective positions within a particular wellbore while the term "levels" is meant to refer to respective positions lying along the wellbore between the terminals of the fracture interval 12.

A fracturing workstring 20 is positioned in wellbore 11 substantially adjacent fracture interval 12. Fracturing workstring 20 is comprised of a string of tubing 21 or the like which is open at its lower end 22 and which extends to the surface (not shown). A typical "cross-over" 23 is connected into workstring 20 and is positioned to lie at the top of fracture interval 12 when the workstring is in its operable position within the wellbore 11. Packer 15 is carried on the exterior of workstring 20 to isolate the fracture interval 12.

In accordance with the present invention, workstring 20 has one or more shunt tubes 25 which are radially-spaced around the workstring 20 and which extend vertically from just below cross-over 23 to the lower end 22 of tubing 21. These shunt tubes each has a plurality of openings 26 spaced along its length which provide "alternate flowpaths" for the delivery of fluids to different levels within the fracture interval 12 for a purpose to be discussed in detail below. Each shunt tube may be open at its ends to allow fluids to enter therein or provide entry of fluids through appropriate openings 26 (e.g. those near the top and bottom of the tube). Shunts tubes of this type have been used to provide alternate flowpaths for fluids in a variety of different well operations, see U.S. Pat. Nos. 4,945,991; 5,082,052; 5,113,935; 5,161,613; and 5,161,618.

While openings 26 in each of the shunt tubes 25 may be a radial opening extending from the front of the tube, preferably the openings extend from each side of the shunt tube 25, as shown. Further, it is preferred that an exit tube 24*a* (only four shown in FIG. 5) is provided for each opening 24. The construction and purpose for exit tubes 24*a* is fully disclosed and claimed in applicant's co-pending U.S. application, Ser. No. 08/155,513, filed Nov. 22, 1993, which is incorporated herein by reference.

Figure 5:
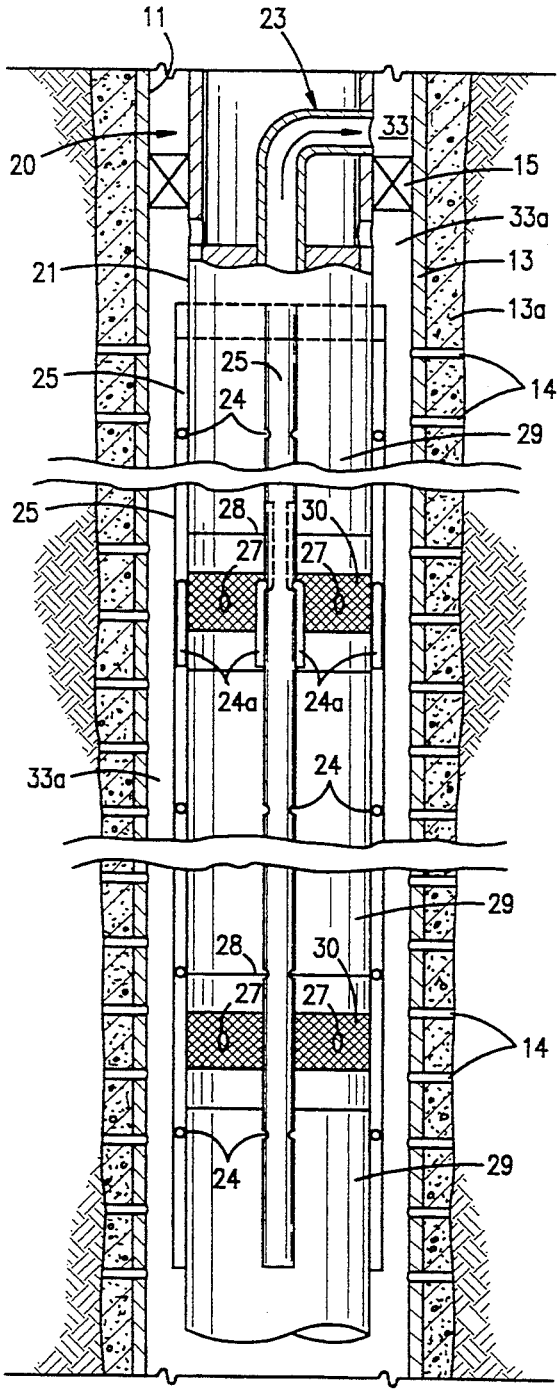
FIG. 5 is an enlarged, elevational view, partly in section, of a portion of the apparatus used in FIGS. 1 to 4 for carrying out the present invention.

The portion of tubing string 21 below cross-over 23 has a plurality of radial, "unloading" ports 27 spaced vertically along its length. As best seen in FIG. 5, these ports are preferably provided in couplings 28 which connect the joints 29 of tubing string 21 together. A screen 30 covers each of the ports 29 which allows fluids to flow through ports 29 but which prevents particulate material from flowing into workstring 20.

In operation, if wellbore 11 extends for a distance substantially below the bottom of fracture interval 12, the wellbore is blocked-off adjacent the lower end of fracture interval 12 by a plug or packer 31, as will be understood in the art. Fracturing workstring 20 is lowered into wellbore 11 which, in turn, forms a well annulus 33 between workstring 20 and the wellbore 11. In deeper wells, packer 15 is then set to isolate that portion 33*a* of the annulus which lies adjacent fracture interval 12. In shallower wells, packer 15 would not be necessary and annulus 33 would be open to the surface.

A fracturing fluid (solid arrows in FIGS. 1–3) is then flowed down the wellbore and into the annulus adjacent the fracture interval. In shallow wells wherein packer 15 and cross-over 23 are not used, the fracturing can be flowed into either end of the annulus (i.e. (a) into the top of the annulus by closing the top of workstring 20 and flowing the fracturing fluid directly through annulus 33 or (*b*) into the bottom of the annulus by closing the top of the annulus 33 and flowing the fracturing fluid down the workstring 20) or the fracturing fluid can be flowed down both workstring 20 and annulus 33 into both ends of the annulus simultaneously.

The fracturing fluid used in the present invention can be any well-known fluid commonly used for fracturing formation (e.g. water, muds, etc.) but is preferably is one of the many commercially-available substantially, particle-free "gels" which are routinely used in conventional fracturing operations (e.g. Versagel, product of Halliburton Company, Duncan, Okla.).

As illustrated in the drawings, in deeper wells, the fracturing fluid is shown as simultaneously flowing into both ends of isolated annulus 33*a* to initiate a fracture. That is, the fracturing fluid flows down the workstring 20, through openings 40 in cross-over 23, and into the top of annulus 33*a* while additional fracturing fluid flows downward through annulus 33, pipe 41 of cross-over 23, out the lower end of workstring 20, and into the bottom of annulus 33*a*. It should be understood, that the fracturing fluid can be flowed into only one end (i.e. either end) of annulus 33*a* to initiate a fracture if the situation dictates. This is done by flowing the fracturing fluid down either workstring 20 or annulus 33 while closing the other to flow.

The flowing fracture fluid fills annulus 33*a* and will initiate a fracture A in fracture interval 12. This is also true in shallow wells. While the fracture is shown in FIG. 1 as being initiated at an upper level of fracture interval 12, it should be understood that this fracture may be initiated at any level within the fracture interval 12, that being the level at which the formation has the lowest "break-down" pressure, depending on the particular formation being fractured.

Once the fracture has been sufficiently initiated, the flow of fracturing fluid is continued to one end of annulus 33*a* while slurry is flowed to the other end thereof. As illustrated, the flow of fracturing fluid down annulus 33 is continued while the flow of fracturing fluid through the workstring 21 is replaced with flow of a slurry (dotted arrows in FIGS. 2 and 3) which is laden with proppants (e.g. gravel and/or sand). The fracturing fluids continues to flow into the lower end of annulus 33*a* while the slurry flows into the upper end of the annulus. This is the preferred mode but it should be understood that the flows could be reversed if the situation dictates.

Figure 2:
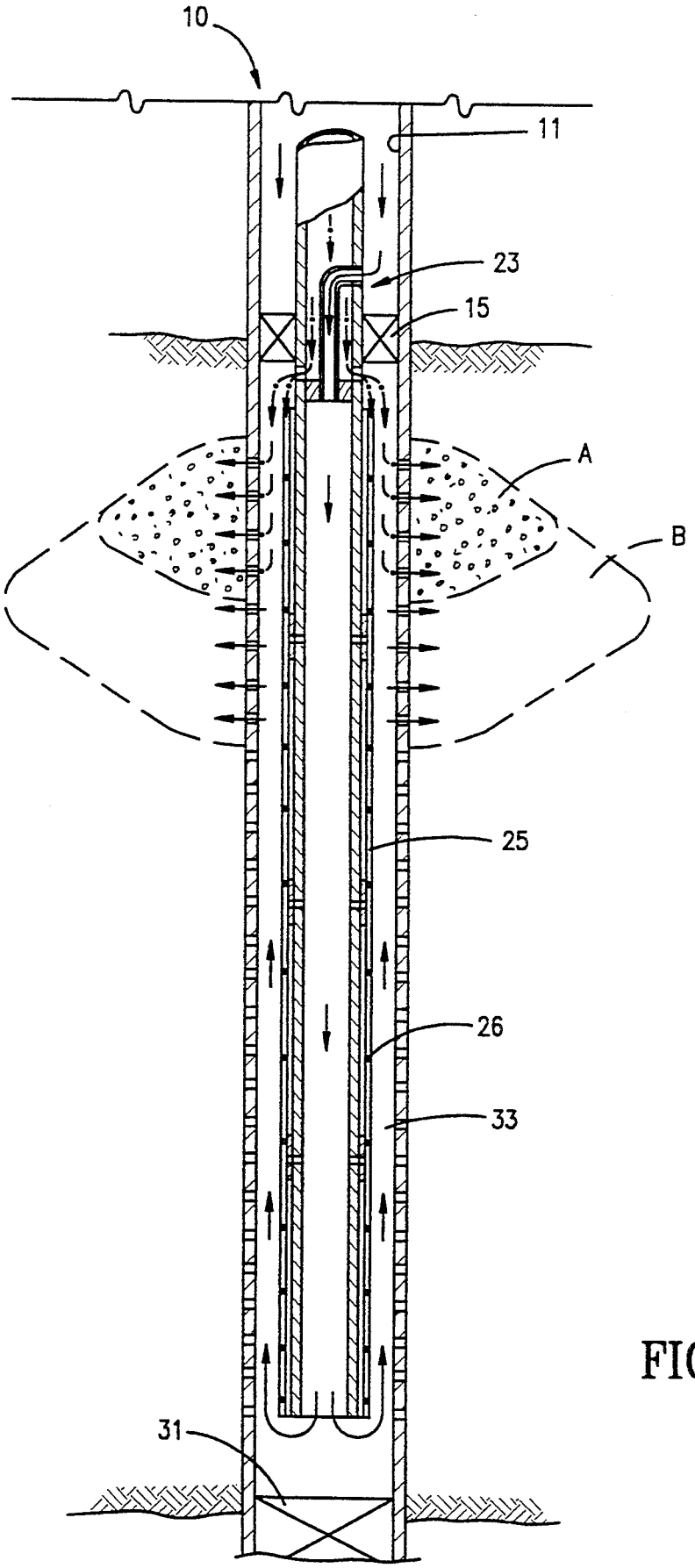
FIG. 2 is an elevational view, partly in section, similar to that of FIG. 1 wherein the initial fracture is being extended and the initial fracture is being propped with proppants.
Figure 3:
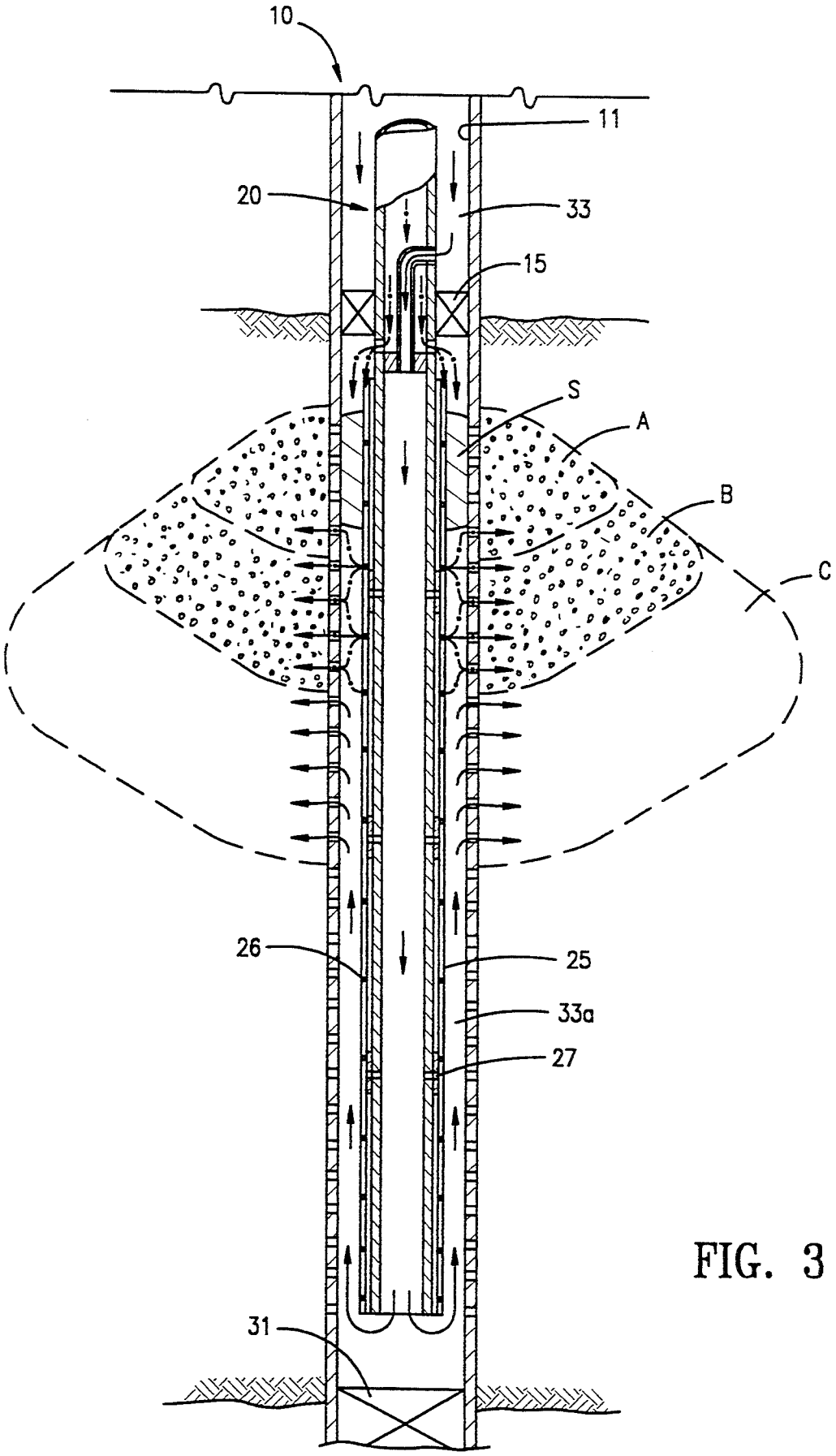
FIG. 3 is an elevational view, partly in section, similar to that of FIG. 1 wherein the initial fracture is being extended even further and the resulting fracture is being propped with proppants.

The slurry flows into initial fracture A to deposit the proppants and thereby prop the fracture while the fracturing fluid flowing upward from the the bottom of annulus 33*a* will continue to fracture the formation and enlarge the initial fracture A as indicated by dotted line B in FIG. 2.

Under normal conditions such as those in conventional fracturing techniques, the slurry will lose liquid as it flows into the formation and proppants (i.e. particulate material) will settle out in the annulus 33*a* at a point adjacent the initial fracture A. This results in the formation of a sand bridge (S in FIG. 3) in the annulus which, in turn, blocks flow of slurry to the lower portion of annulus 33*a*. Even though the fracturing fluid through the lower end of the annulus may continue to enlarge the fracture (e.g. C in FIG. 3), no slurry can reach the enlarged portion of the fracture and accordingly, this portion of the fracture remains unpropped.

In accordance with the present invention, the flow of slurry is continued through the upper end of the annulus 33*a* while fracturing fluid is flowed through the lower end thereof. The slurry, while blocked by sand bridge S in annulus 33*a*, is free to flow into the open, upper ends of shunts tubes 25 and down therethrough and out the openings 26 therein. It can be seen that the alternate flowpaths provided by the shunts 25 provide a bypass around bridge S and will deliver the slurry to the different levels within fracture intervals (e.g. those represented by dotted lines B and C) whereby slurry can flow into and prop the enlarged portions of the fractures (see FIG. 3).

The simultaneous injection of fracturing and slurry is continued until the fracture interval is fractured and propped across substantially its entire thickness or length. It should be recognized that the individual flow rates of the fracturing fluid and the slurry can be varied to adjust the desired direction of flow of the fracturing fluid and slurry through the alternate flowpaths to achieve the desired fracturing and propping across the fracture interval.

As mentioned above, the fracture may be initiated at some level other than at the top of interval 12 as illustrated. For example, the fracture may be initiated at the middle of interval 12. The alternate flowpaths of the present invention will still allow the enlargement and propping of the fracture above and/or below the initial fracture by allowing either the fracturing fluid to flow upward through the shunt tubes to levels above any sand bridges that may be formed and/or the slurry to flow downward through the shunt tubes to levels below the bridge. This is accomplished by adjusting the respective rates of flow for the fracturing fluid and the slurry into annulus 33*a* as the fracturing operation proceeds.

As will be understood by those skilled in the art, except in unconsolidated formations, it is usually desirable to remove fracturing workstring 20 after the completion of the fracturing operation. This may be difficult in most instances due to the proppants, e.g. sand, which fill and remain in annulus 33*a* after the fracturing and propping operation is completed. To remove workstring 20, the lower wellbore annulus has to be "unloaded". One way to accomplish this is to pump a wash fluid (e.g. water) down the annulus 33, through pipe 41 in cross-over 23, down the interior of lower workstring 20, and back to the surface in the reverse circulation mode.

As the wash fluid flows downward in lower workstring 20 under pressure, it will flow out the lower end of the workstring and also through "unloading" ports 27 to churn-up and wash the sand in annulus 33*a* upward through openings 40 in cross-over 23 and on to the surface through the upper portion of the workstring. Any flow of fracturing fluid through ports 27 during the fracturing operation is of no consequence since annulus 33*a* is already filled with fracturing fluid under pressure. Likewise, there will only minor amounts of liquid from the slurry flow inward through ports 27 during the fracturing operation. Screens 30 will prevent any proppants from flowing into and blocking ports 27 during the flow of slurry through annulus 33*a* so the ports will remain open for the unloading of the workstring.

Figure 4:
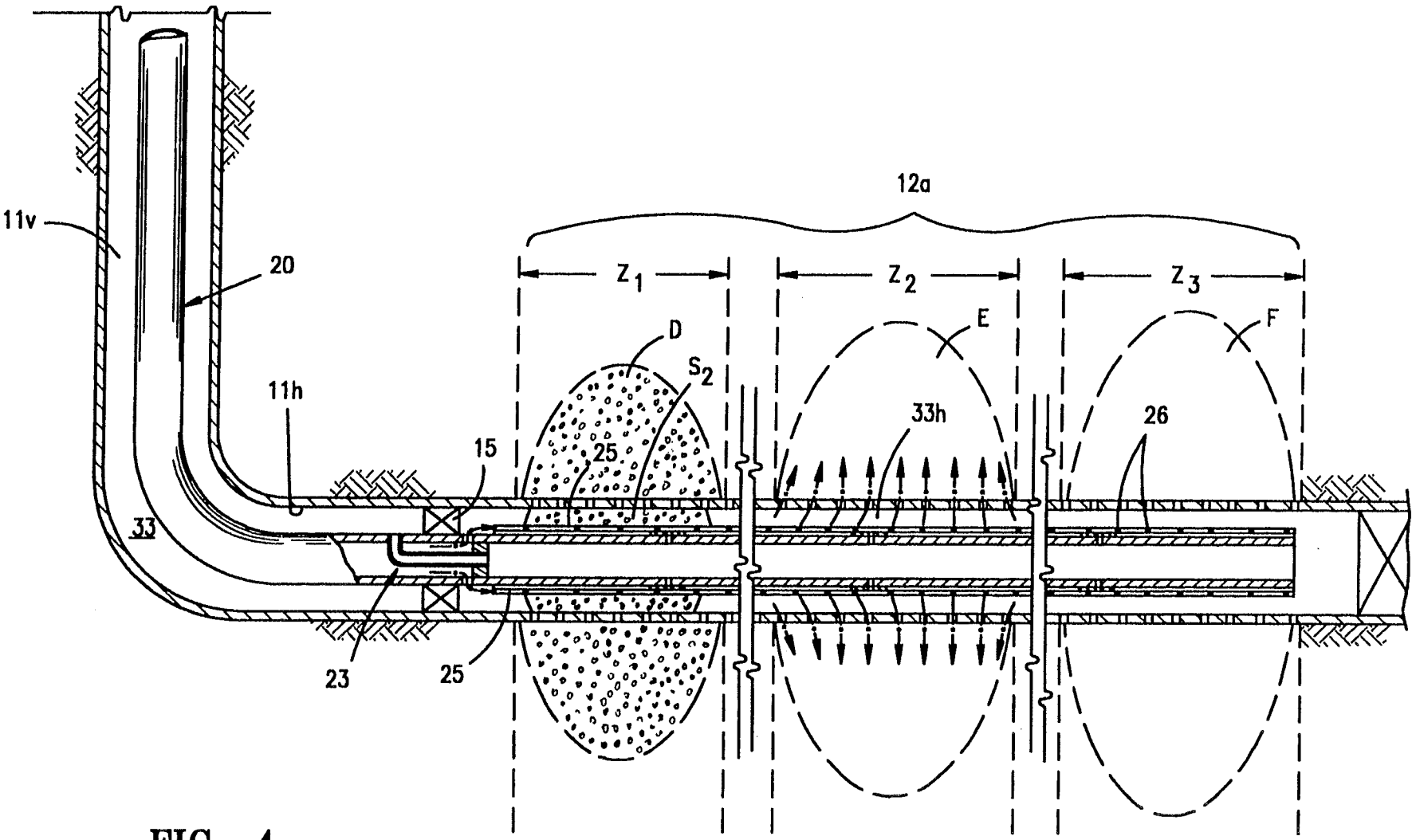
FIG. 4 is an elevational view, partly in section, illustrating the present invention as carried out in a horizontal well.

FIG. 4 illustrates the present invention as it is carried out in a horizontal well. As will be understood in this art, well 10*a* has a vertical portion 11*v* which extends from the surface and a horizontal portion 11*h* which extends outward from the lower end of portion 11*v*. Basically, fracturing workstring 20 is identically to that described above and the operational steps are the same with the only difference being that the fracture interval 12*a* in FIG. 4 is comprised of a plurality of zones $Z_1$, $Z_2$, and $Z_3$ which are horizontally spaced along wellbore 11 *h*.

In carrying out the fracturing operation of FIG. 4, fracturing fluid is flowed down either or both workstring 20 and well annulus 33, through cross-over 23 (if present) and into either of both the top and bottom of annulus 33*h* to initiate a first fracture, e.g. fracture D in $Z_1$. This can be encouraged by selective perforating the casing at desired levels. The flow of fracturing fluid is continued through one end of annulus 33*h* (e.g. the bottom) while slurry with proppants is flowed into the other end of the annulus 33*h* (e.g. the top) to prop the initial fracture D. The fracturing fluid, now instead of enlarging fracture D, will initiate a second fracture (E in $Z_2$). If a sand bridge $S_2$ forms in the annulus, slurry flows through the alternate paths provided by shunts 25 to prop the fracture E while the continued flow of fracturing fluid through the lower end of annulus 33*h* will initiate a third fracture (e.g. F in $Z_3$) and so on.

The alternate flow paths provided by shunts 25 allow the slurry to reach and prop all of the fractures along wellbore 11*h* even as sand bridges form in annulus 11*h*. As before, the order in which the fractures are initiated is not critical since the shunt tubes 25 allow either the fracture fluid or the slurry to bypass sand bridges in the annulus in response to the respective flow rates.

Figure 6:
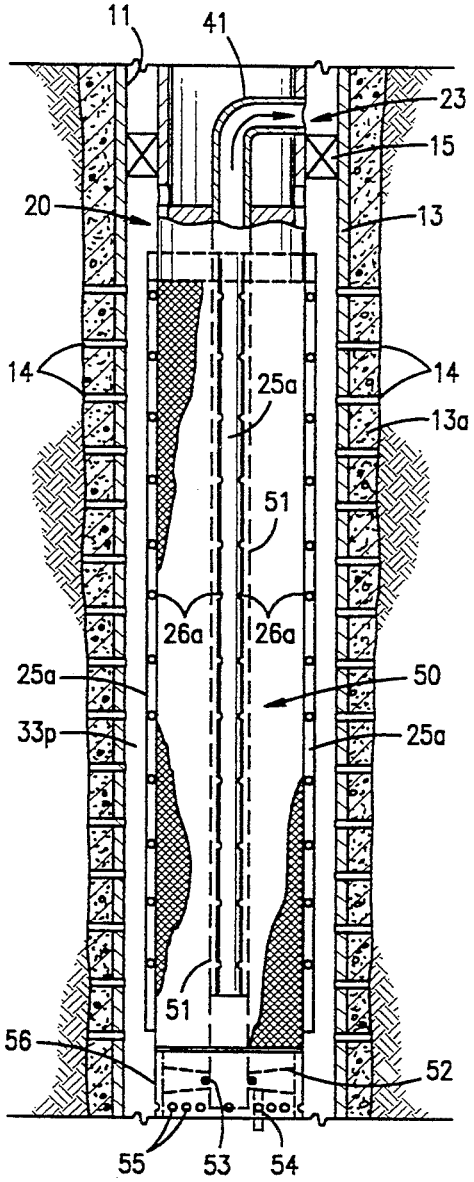
FIG. 6 is an elevational view, partly in section, of a gravel-pack screen which is used to carry out another embodiment of the present invention.

It is also possible to use the present invention to fracture, prop, and gravel pack an injection or production inverval within a well, all with a single operation. As illustrated in FIG. 6, a gravel pack screen 50 is connected into the lower end of workstring 20*a*. "Gravel pack screen" or "screen" as used herein, is intended to be generic and to include screens, slotted pipes, screened pipes, perforated liners, pre-packed screens and/or liners, combinations of same, etc. which are used in well completions of this general type. Screen 50 may be of a continuous length, as shown, or it may be comprised of a plurality of screen segments connected together by subs or "blanks". A plurality of shunt tubes 25*a* having opening 26*a* therein are spaced radially around screen 50 and extend throughout the interval to be fractured and completed.

As illustrated, a wash pipe 51 is connected to pipe 41 of cross-over 23 and, although illustrated as extending through screen 50, it should be understood that wash pipe 51 can terminate within the lower portion of screen 50 wherein the fracturing fluid will enter the lower end of annulus 33*p* through the screen, itself. Returning now to FIG. 6, the lower end of wash pipe 51 is shown passing through an opening in bottom plate 52 and is sealed therewith by a seal (e.g. O-ring 53 or the like). As pipe 51 passes through plate 52, a spring-biased flapper valve 54 or the like is pushed downward and is held in an open position by the wash pipe. The underside of plate 52 can be open to annulus 33*p* or can be in fluid communication with annulus 33*b* through openings 55 in tattletale 56, as will be understood by those skilled in the art.

A fracturing and propping operation which includes gravel pack screen 50 is basically the same as described above. Fracturing fluid is flowed down through either or both workstring 20*b* and annulus 33, through cross-over 23 and wash pipe 51, and into both the top and the bottom of annulus 33*p*. After a fracture is initiated (not shown), slurry with proppants is flowed down the the workstring and into the one end of the annulus 33*p* while the flow of fracturing fluid is continued into the other end of the annulus.

If, or as, a sand bridge forms in the annulus, shunts 25*a* provide alternate flowpaths for delivering the slurry/fracturing fluids to other levels in the fracture intervals in the same manner as described above. After achieving the desired fracture across the fracture interval, the flow of fracturing fluid is halted and the flow of slurry is continued until the annulus 33*p* around gravel pack screen is filled or packed with gravel. Since the screen is to be left in the wellbore, there is no need to "unload" the annulus surrounding the screen.

As the cross-over 23 and wash pipe 51 is removed to the surface, if flapper valve 54 is used, it will be biased shut to prevent any production of particulates through screen 50. The use of flapper valve 54 or its equivalent allows the flow of slurry to the lower end of screen 50 without getting sand in the interior of the screen so that a "bottom up" gravel packing operation can be carried out, if desired.

In the present invention, the alternate flow paths continue to deliver the slurry and/or fracturing fluid to the different levels or zones of the fracture interval so that thick and/or non-homogeneous intervals can be fractured and propped and gravel packed during a single operation regardless of which level or zone fractures first or whether or not sand bridges form in the wellbore during the fracturing operation.

What is claimed is:

1. A method for fracturing and propping a fracture interval of a subterranean formation which is traversed by a wellbore, said method comprising:

positioning a workstring in the wellbore to form a well annulus between said workstring and said wellbore;

flowing a fracturing fluid from the surface through a first flowpatch into at least one end of that portion of said well annulus which lies adjacent to said fracture interval to thereby initiate a fracture in said fracture interval;

flowing a slurry containing proppants from the surface through a separate second flowpath into an opposite end of the fracture interval annulus while continuing to flow fracturing fluid through said first flowpath into said one end of said fracture interval annulus; and delivering said slurry containing proppants through alternate flowpaths to different levels within said fracture interval annulus while continuing to flow said slurry through said opposite end of said fracture interval annulus and said fracturing fluid through said one end of said fracture interval annulus.

2. The method of claim 1 wherein said first flowpath through which said fracturing fluid flows is down said well annulus into the top of said fracture interval annulus.

3. The method of claim 1 wherein said first flowpath through which said fracturing fluid flows is down said workstring into the bottom end of said fracture interval annulus.

4. The method of claim 1 wherein said fracturing fluid is flowed into both ends of said fracture interval annulus simultaneously.

5. The method of claim 1 including:

isolating said portion of said annulus which lies adjacent said fracture interval prior to flowing said fracturing fluid into at least one end of the fracture interval annulus.

6. The method of claim 5 wherein said fracturing fluid is flowed through the one end of said isolated fracture interval annulus as said slurry with proppants is flowed through the other end of said isolated fracture interval annulus.

7. The method of claim 5 wherein said workstring includes a cross-over and wherein said fracturing fluid is flowed down said well annulus, through said cross-over in said workstring, and into said bottom end of said isolated fracture interval annulus while said fracturing fluid is also being flowed down said workstring, out of said cross-over, and into the top of said isolated fracture interval annulus to thereby initiate said fracture in said fracture interval.

8. The method of claim 7 wherein said slurry fracturing fluid is flowed down said well annulus, through said cross-over into said workstring, and into said bottom end of said isolated fracture interval annulus while said slurry with proppants is also being flowed down said workstring, out of said cross-over, and into the top of said isolated fracture interval annulus to thereby prop said initial fracture in said fracture interval.

9. The method of claim 8 wherein said alternate flowpaths are provided by shunt tubes which are spaced radially around said workstring and which extend through said fracture interval, each of said shunt tubes having inlet and outlet openings spaced along its length.

10. The method of claim 1 wherein said fracturing fluid is a fracturing gel and said proppants are sand.

11. The method of claim 1 including:

ceasing flow of both said fracturing fluid and said slurry with proppants when said fracture interval has been fractured and propped; and flowing a wash fluid down said wellbore to unload said workstring whereby said workstring can be removed from said wellbore.

12. A method for fracturing, propping, and gravel-packing a fracture interval of a subterranean formation which is traversed by a wellbore, said method comprising:

positioning a workstring in the wellbore to form a well annulus between said workstring and said wellbore, said workstring including a gravel pack screen which lies adjacent said fracture interval to form a fracture interval annulus when said workstring is in place within said wellbore;

flowing a fracturing fluid from the surface through a first flowpath into at least one end of said fracture interval annulus to thereby initiate a fracture in said fracture interval;

flowing a slurry containing proppants from the surface through a separate second flowpath into an opposite end of said fracture interval annulus while continuing to flow fracturing fluid through said first flowpath into said one end of said fracture interval annulus; and delivering said slurry containing proppants through alternate flowpaths to different levels within said fracture interval annulus while continuing to flow said slurry through said opposite end of said fracture interval annulus and said fracturing fluid through said one end of said fracture interval annulus.

13. The method of claim 12 including:

isolating said fracture interval annulus prior to flowing said fracturing fluid into said at least one end of said fracture interval annulus.

14. The method of claim 13 wherein said fracturing fluid is flowed through said first flowpath into the bottom end of said isolated annulus as said slurry with proppants is flowed through said second flowpath into the top end of said isolated annulus.

15. The method of claim 14 wherein said workstring includes a cross-over and wherein said fracturing fluid is flowed down said well annulus, through said cross-over into said workstring, and into said bottom end of said isolated fracture interval annulus while said fracturing fluid is also being flowed down said workstring, out of said cross-over, and into the top of said isolated fracture interval annulus to thereby initiate said fracture in said fracture interval.

16. The method of claim 15 wherein said slurry fracturing fluid is flowed down said well annulus, through said cross-over into said workstring, and into said bottom end of said isolated fracture interval annulus while said slurry with proppants is also being flowed down said workstring, out of said cross-over, and into the top of said isolated fracture interval annulus to thereby prop said initated fracture in said fracture interval.

17. The method of claim 16 wherein said alternate flowpaths are provided by shunt tubes which are spaced radially around said workstring and which extend through said fracture interval, each of said shunt tubes having inlet and outlet openings spaced along its length.

18. The method of claim 17 including:

ceasing flow of said fracturing fluid when said fracture interval has been fractured and propped; and continuing to flow slurry with proppants through at least one end of said isolated fracture interval annulus to deposit proppants in said isolated fracture interval annulus around said gravel pack screen.

19. The method of claim 12 wherein said fracturing fluid is a fracturing gel and said proppants is sand.

* * * * *